US009615620B2

(12) United States Patent
Miranda

(10) Patent No.: US 9,615,620 B2
(45) Date of Patent: Apr. 11, 2017

(54) MULTI-LAYER ASSEMBLY FOR PROTECTION OF HEADWEAR AND OTHER OBJECTS

(71) Applicant: Michael Louis Miranda, Chino, CA (US)

(72) Inventor: Michael Louis Miranda, Chino, CA (US)

( * ) Notice: Subject to any disclaimer, the term of this patent is extended or adjusted under 35 U.S.C. 154(b) by 0 days.

(21) Appl. No.: 13/935,506

(22) Filed: Jul. 4, 2013

(65) Prior Publication Data

US 2016/0316848 A1 Nov. 3, 2016

(51) Int. Cl.
*A42C 5/02* (2006.01)

(52) U.S. Cl.
CPC ..... *A42C 5/02* (2013.01)

(58) Field of Classification Search
CPC ..... A42B 1/22; A42C 5/02
USPC ..... 2/181, 171, 181.3, 181.4, 272, 175.1
See application file for complete search history.

(56) References Cited

U.S. PATENT DOCUMENTS 5,313,668 A * 5/1994 Bogan ..... A42C 5/02 2/181.4
5,632,046 A * 5/1997 Green ..... A42B 1/22 2/175.1
5,915,534 A * 6/1999 May ..... A42C 5/02 2/181
8,112,821 B1 * 2/2012 Barry ..... A42C 5/02 2/181
2004/0146717 A1 * 7/2004 Corzani ..... A41D 19/0058 428/422.8
2005/0004542 A1 * 1/2005 Bakkila ..... A47G 23/032 604/367
2007/0163027 A1 * 7/2007 Hamilton ..... A41D 31/02 2/171
2008/0301854 A1 * 12/2008 Kingto ..... A42C 5/02 2/181
2011/0072555 A1 * 3/2011 Asiatico ..... A42C 5/02 2/181.4

(Continued)

*Primary Examiner* — Gloria Hale
(74) *Attorney, Agent, or Firm* — William J. Benman; Benman, Brown & Williams

(57) ABSTRACT

A lid liner adapted for use as an add-on for a garment such as a hat or cap. The inventive lid liner is a removable multilayer construction of absorbent material adapted for easy manual removal without the use of scissors or tools of any kind. The lid liner includes: a first wicking layer, a second absorbent layer, a third water repellent layer and a fourth adhesive layer for retaining the layer of absorbent material between a wearer and the garment. The first, second, third and fourth layers are disposed in adjacent parallel relation whereby the first layer has first and second edges thereof that extend at least partially over the second and third layers and terminate on and are secured by the fourth adhesive layer. The material is positioned in the cap or hat to absorb perspiration from the wearer and thereby protect the garment. In the illustrative embodiment, a protective strip of paper is removed from the adhesive layer and the multilayer construction is positioned inside the garment such that it is retained by the adhesive layer to the garment in a position at which the multilayer construction is positioned between the head of a wearer and the garment when the garment is placed on the head of the wearer.

2 Claims, 4 Drawing Sheets

(56) References Cited

U.S. PATENT DOCUMENTS

| | | | | |
|---|---|---|---|---|
| 2011/0296579 | A1* | 12/2011 | Galvan | A42C 5/02 2/60 |
| 2013/0247281 | A1* | 9/2013 | Zebouni | A42C 5/02 2/272 |
| 2014/0137311 | A1* | 5/2014 | Sandoval | A42B 1/063 2/181 |

* cited by examiner

MULTI-LAYER ASSEMBLY FOR PROTECTION OF HEADWEAR AND OTHER OBJECTS

BACKGROUND OF THE INVENTION

Field of the Invention

The present invention relates to clothing. More specifically, the present invention relates apparatus and methods for protecting hats and caps from perspiration.

Description of the Related Art

Most body heat is lost through the head. Hats and baseball type caps are typically made of a clothing material such as wool, polyester, cotton or leather and have a headband designed to protect the hat or cap from sweat. Unfortunately, hat headbands are hard to keep clean as the headbands absorb perspiration, accumulate bacteria and leave an unattractive ring or area of discoloration on the hat or cap. The accumulation of dirt and bacteria can also cause irritation and odor. Hence, the headband must be cleaned periodically. However, the washing of a hat headband, by hand or machine, can damage the structure or shape of the garment, diminish its color and/or change its fit.

Consequently, a need exists in the art for a system or method for obviating the need to wash a cap or hat.

SUMMARY OF THE INVENTION

The need in the art is addressed by the headwear or lid liner of the present invention adapted for use as an add-on for a head wear garment such as a hat or cap. In the illustrative embodiment, the inventive or headwear lid liner is a removable multilayer construction of absorbent material adapted for easy manual removal without the use of scissors or tools of any kind and, in the illustrative embodiment, includes: a first absorbent layer, a second wicking layer, a third water repellent layer and a fourth adhesive layer for retaining the layer of absorbent material between a wearer and the garment. The first, second, third and fourth layers are disposed in adjacent parallel relation whereby the first layer has first and second edges thereof that extend at least partially over the second and third layers and terminate on and are secured by the fourth adhesive layer. The material is positioned in the cap or hat to absorb perspiration from the wearer and thereby protect the garment.

In the illustrative embodiment, a protective strip of paper is removed from the adhesive layer and the multilayer construction is positioned inside the garment such that it is retained by the adhesive layer to the garment in a position at which the multilayer construction is positioned between the head of a wearer and the garment when the garment is placed on the head of the wearer.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
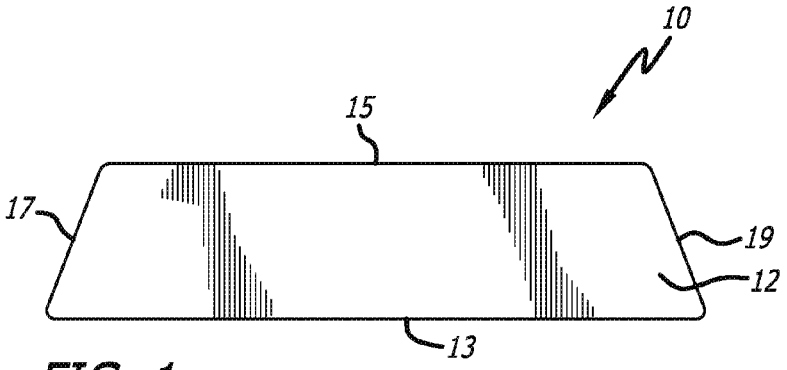
FIG. 1 is a front view of an illustrative embodiment of the headwear or lid liner of the present invention.

FIG. 1 is a front view of an illustrative embodiment of the lid liner of the present invention. The inventive lid liner 10 adapted for use as an add-on for a garment such as a hat or cap. This is illustrated in FIGS. 2 and 3.

Figure 2:
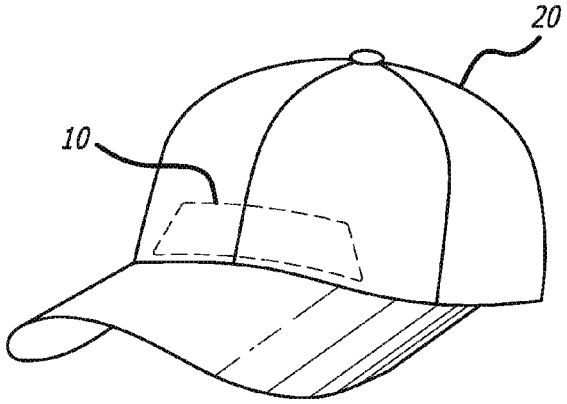
FIG. 2 is a front view of a cap within which the inventive headwear or lid liner is mounted.

FIG. 2 is a front view of a cap 20 within which the inventive lid liner 10 (shown in phantom) is mounted.

Figure 3:
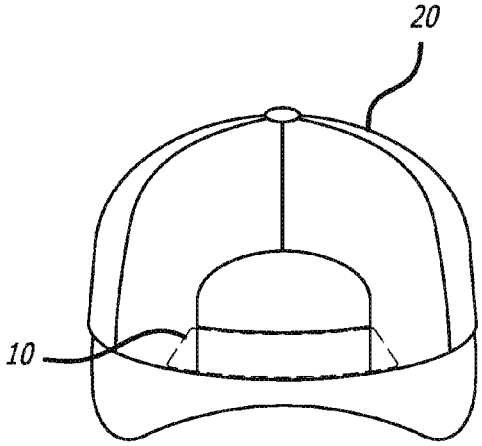
FIG. 3 is a rear view of the cap depicted in FIG. 2.

FIG. 3 is a rear view of the cap depicted in FIG. 2.

As shown in FIGS. 1-3, in the best mode, the head wear or lid liner 10 is trapezoidal in shape to effectuate a better fit within the cap or hat 20. Thus, the bottom edge 13 is longer than the top edge 15 causing the side edges 17 and 19 to be slanted. In the illustrative embodiment, the top edge 15 is 178 mm to 184 mm; the bottom edge 13 is 210 mm to 216 mm. Others dimensions may be used to effect a preferred angle of the side edges 17 and 19 of approximately 20° to 80° depending on the requirements of the garment or application.

In the illustrative embodiment, the inventive lid liner is a removable multilayer construction of absorbent material adapted for easy manual removal without the use of scissors or tools of any kind and, in the illustrative embodiment. This multilayer construction is illustrated in FIG. 4.

Figure 4:
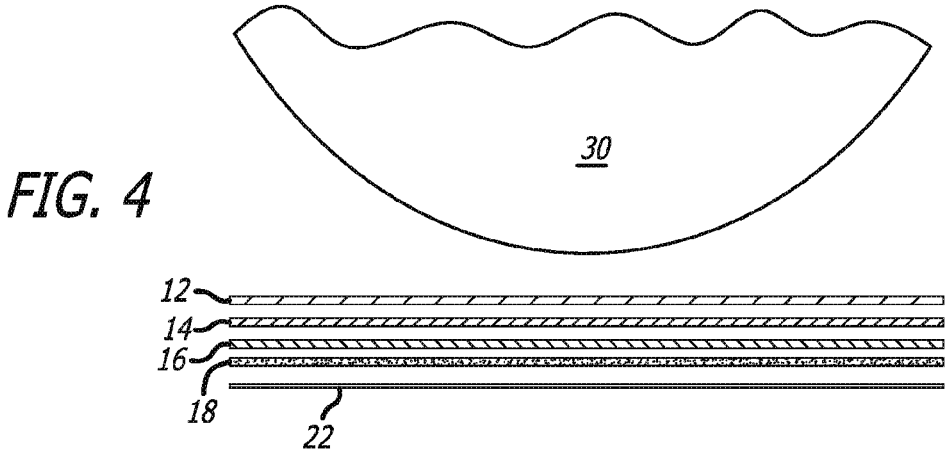
FIG. 4 is a top view of the headwear or lid liner of FIG. 1 in disassembled relation.

FIG. 4 is a top view of the headwear or lid liner 10 of FIG. 1 in disassembled relation. As shown in FIG. 4, the headwear or lid liner 10 includes: a first wicking layer 12, a second absorbent layer 14, a third water repellent layer 16 and a fourth adhesive layer 18 for retaining the layer of absorbent material between a wearer 30 and a garment 20 (not shown). The first, second, third and fourth layers are disposed in adjacent parallel relation whereby the first layer has first and second edges thereof that extend at least partially over the second and third layers and terminate on and are secured by the fourth layer and the material is positioned to absorb perspiration from the wearer and thereby protect the headwear garment.

In the best mode, the first layer 12 is nonwoven and made of cotton or other suitably wicking material and has an approximate thickness of 0.11 mm to 2 mm.

The second layer 14 is air laid and serves as an absorbent layer designed to retain moisture. The air laid-layer is designed with small air pockets to absorb and hold moisture.

The third layer 16 is a water repellent layer design to retain moisture in the absorbent layer 14 and protect the cap 20 there from. The third layer may be a protective environment (PE) film or other suitably water repellent synthetic material. The PE protective environment layer 16 prevents moisture from penetrating to the headband of the hat.

The fourth layer 18 is an adhesive layer.

Figure 5:
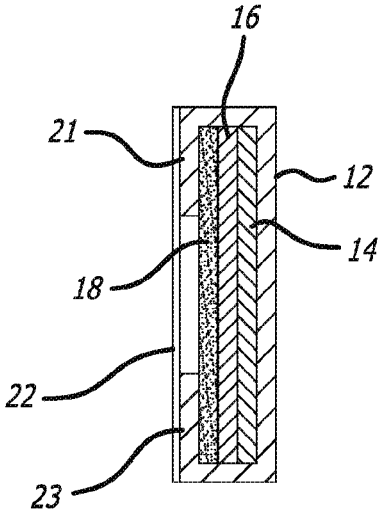
FIG. 5 shows a side view of the headwear or lid liner of the present invention.
Figure 6:
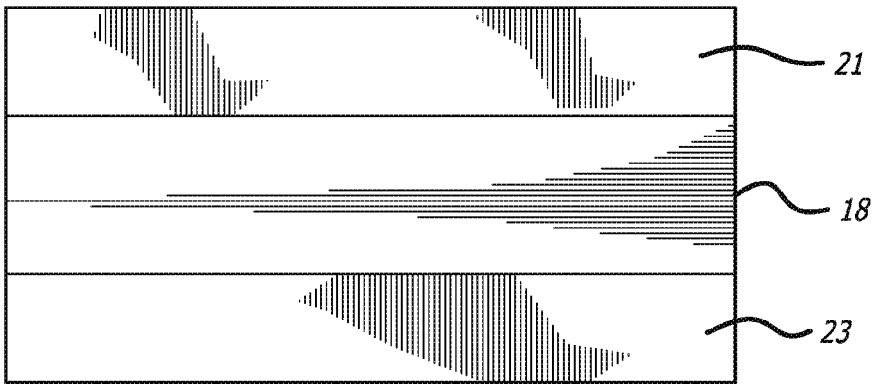
FIG. 6 illustrates the fold over of the first layer onto the fourth layer in accordance with the present teachings.

In accordance with the present teachings and as shown in FIGS. 5 and 6, the first layer is wrapped over and under the second, third and fourth layers and has folds or flaps thereof 21 and 23 which are pressed against and retained by the adhesive layer 18.

FIG. 5 shows a side view of the headwear or lid liner of the present invention.

FIG. 6 illustrates the fold over of the first layer onto the fourth layer in accordance with the present teachings.

In the illustrative embodiment, a protective strip of wax paper 22 is positioned over the adhesive layer. When the protective strip 22 is peeled away, the multilayer construction 10 is positioned inside the headliner of the headwear garment such that it is retained by the adhesive layer to the headwear garment in a position at which the multilayer construction is positioned between the head of a wearer and the headwear garment when the headwear garment is placed on the head of the wearer.

Figure 7:
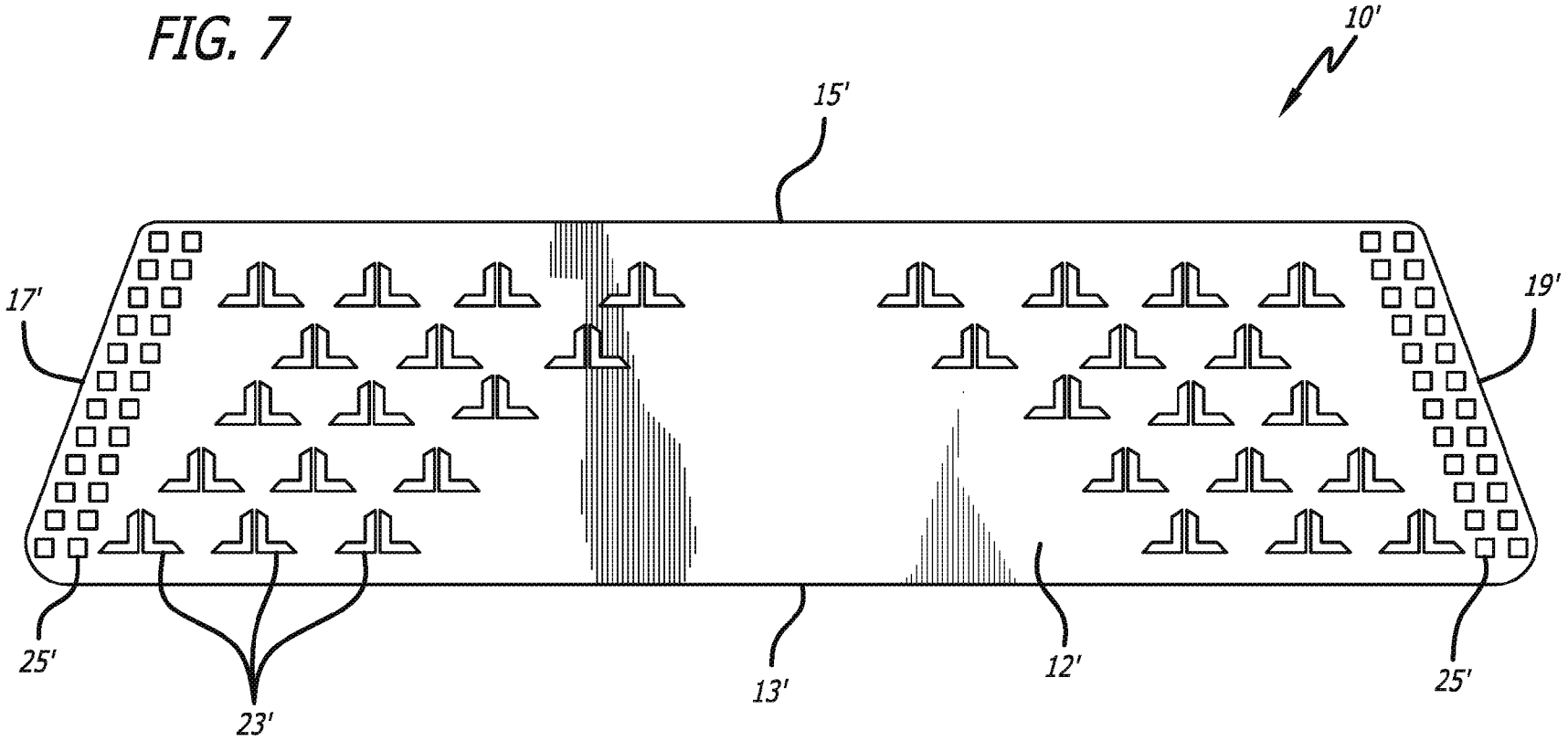
FIG. 7 shows an embodiment in which the first layer is perforated with apertures that facilitate the flow of perspiration through to the second layer (not shown).

FIG. 7 shows an embodiment 10' in which the first layer 12' is perforated with apertures 23' that facilitate the flow of perspiration through to the second layer 14' (not shown). Additional perforations 25' are provided along the side edges 17' and 19'. Those skilled in the art will appreciate that the present invention is not limited to the use of the perforations 25'.

Figure 8:
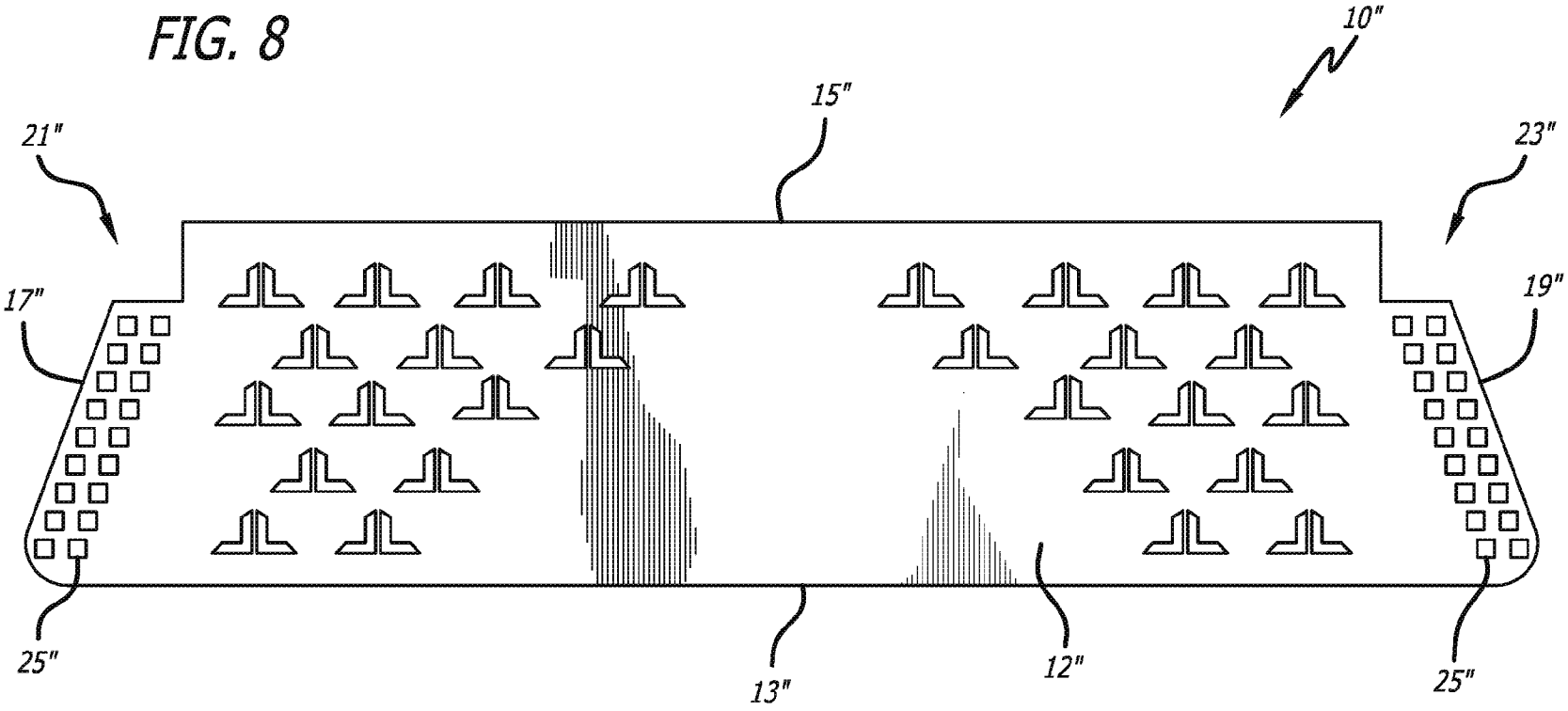
FIG. 8 shows a second alternative embodiment of the present invention in which the side edges have cutouts.

FIG. 8 shows a second alternative embodiment 10" in which the side edges 17" and 19" have cutouts 21" and 23" respectively. This design offers improved fit in the headwear.

Thus, the present invention has been described herein with reference to a particular embodiment for a particular application. Those having ordinary skill in the art and access to the present teachings will recognize additional modifications, applications and embodiments within the scope thereof. For example, the present invention is not limited to use with hats, caps and other headwear garments. The invention may be used in any application where an adhesive absorbent is needed between a user and a surface without departing from the scope of the present teachings. In addition, one or more of layers may be implemented with a cooling gel or beads that respond to moisture by becoming colder or more absorbent. Fragrances may be added and special purpose substances such as *aloe vera* may be used to mitigate irritation.

It is therefore intended by the appended claims to cover any and all such applications, modifications and embodiments within the scope of the present invention.

Accordingly,

What is claimed is:

1. A headwear liner for a headwear garment comprising:

a removable multilayer construction of absorbent material adapted for easy manual removal from said headwear garment without the use of scissors or tools of any kind including:

said headwear garment including any one of a hat or cap, a first wicking layer, a second absorbing layer, a third water repellent layer and a fourth adhesive layer for retaining said layer of absorbent material between a wearer of said headwear garment and said headwear garment, said first, second, third and fourth layers being disposed in adjacent parallel relation whereby said first layer has first and second edges thereof that extend at least partially over said second and third layers and terminate on and are secured by said fourth adhesive layer, said material being positioned in the headwear garment of a hat or cap to absorb perspiration from said headwear wearer and thereby protect said garment therefrom.

2. A method for protecting headwear garment of a garment from perspiration including the steps of:

obtaining a headwear garment including any one of a hat or a cap;

providing a removable multilayer construction of absorbent material adapted for easy manual removal from said headwear garment without the use of scissors or tools of any kind including:

a first wicking layer, a second absorbing layer, a third water repellent layer and a fourth adhesive layer for retaining said layer of absorbent material between a wearer of said headwear garment and the headwear garment, said first, second, third and fourth layers being disposed in adjacent parallel relation whereby said first layer has first and second edges thereof that extend at least partially over said second and third layers and terminate on and are secured by said fourth adhesive layer;

removing a protective strip of paper from an adhesive layer of a multilayer construction of absorbent material including: a first wicking layer, a second absorbent layer, a third water repellent layer and the fourth adhesive layer and positioning the multilayer construction inside the headwear garment such that it is retained by the adhesive layer to the headwear garment in a position at which the multilayer construction is positioned between the head of a wearer and the headwear garment when the headwear garment is placed on the head of the wearer.

* * * * *